US007234859B2

(12) United States Patent
Kohler et al.

(10) Patent No.: US 7,234,859 B2
(45) Date of Patent: Jun. 26, 2007

(54) SHOCK-ABSORBING BEARING FOR TIMEPIECE

(75) Inventors: Michel Kohler, Evilard (CH); Romain Voirol, Bienne (CH)

(73) Assignee: Rolex S.A., Geneve (CH)

( * ) Notice: Subject to any disclaimer, the term of this patent is extended or adjusted under 35 U.S.C. 154(b) by 0 days.

(21) Appl. No.: 11/387,423

(22) Filed: Mar. 23, 2006

(65) Prior Publication Data

US 2006/0215499 A1 Sep. 28, 2006

(30) Foreign Application Priority Data

Mar. 23, 2005 (EP) ..... 05405263

(51) Int. Cl.
*G04B 29/00* (2006.01)

(52) U.S. Cl. ..... 368/326

(58) Field of Classification Search ..... 368/324–326
See application file for complete search history.

(56) References Cited

U.S. PATENT DOCUMENTS 2,233,743 A * 3/1941 Marti ..... 368/324
3,146,582 A * 9/1964 Loretan ..... 368/326
3,306,028 A 2/1967 Suzuki
3,712,051 A * 1/1973 Romang et al. ..... 368/326

FOREIGN PATENT DOCUMENTS

CH 294 058 10/1953
CH 325 895 11/1957

* cited by examiner

*Primary Examiner*—Vit W. Miska
(74) *Attorney, Agent, or Firm*—Strum & Fix LLP

(57) ABSTRACT

This shock-absorbing bearing comprises a bearing block (1), a pierced jewel (3), an endstone (4) and a shock-absorbing spring (5) connected to said bearing block (1) by four linking arms (5$a_1$, 5$a_2$, 5$a_3$, 5$a_4$), parallel to a plane containing the pivot axis (X) of said bearing and forming two suspension elements (5$a_1$, 5$c_1$, 5$a_2$; 5$a_3$, 5$c_2$, 5$a_4$), each having two of said linking arms connected to each other by a branch in the form of an arc (5$c_1$, 5$c_2$) centered on said pivot axis (X) and having a radius greater than that of said endstone (4), these suspension elements being connected to each other by two diametric arms (5*e*) located on either side of a central support element (5*d*). The outer ends of said diametric arms (5*e*) are connected to two of said linking arms (5$a_2$, 5$a_4$) belonging to said respective suspension elements (5$a_1$, 5$c_1$, 5$a_2$; 5$a_3$, 5$c_2$, 5$a_4$).

12 Claims, 2 Drawing Sheets

SHOCK-ABSORBING BEARING FOR TIMEPIECE

CROSS REFERENCE TO RELATED APPLICATIONS

This application claims priority of European Application No. 05405263.4 filed Mar. 23, 2005, which is included in its entirety by reference made hereto.

BACKGROUND OF THE INVENTION

1. Field of the Invention

The present invention relates to a shock-absorbing bearing for a timepiece, comprising a bearing block, a pierced bearing jewel, a seat for positioning this bearing jewel in this bearing block, an endstone, a seat for positioning this endstone in this bearing block, and a shock-absorbing spring to hold said endstone against said positioning seat, this shock-absorbing spring being connected to said bearing block by four linking arms, parallel to a plane containing the pivot axis of said bearing, and forming, on each side of this plane, a suspension element having two of said linking arms connected to each other by a branch in the form of an arc centered on said pivot axis and having a radius different from that of said endstone, these suspension elements being connected to each other by two diametric arms located on either side of a central support element.

2. Description of the Related Art

Shock-absorbing bearings, designed in particular for the balance staff, have been the subject of a large amount of research work which culminated between the early 1930s and the end of the 1950s. There are approximately 400 patents in this field, including 250 in the aforementioned period. The solutions used at the present time are satisfactory on the whole, which doubtless explains why this subject has seen practically no recent development.

One of the essential elements of this kind of bearing is the shock-absorbing spring. It must be remembered that the dimensions of such a spring are less than 2 mm and are generally in the region of 1.5 mm. These dimensions give rise to design problems as regards both the elastic limits and plastic deformation, particularly during the fixing of the spring, the retention of the spring in case of shock, the mounting of the spring, and the mounting and dismantling of the bearing.

With most shock-absorbing springs, it is found that either the shock-absorbing spring must be positioned before the bearing support is pressed into the bridge or plate, making it necessary to extract the bearing support in order to dismantle the bearing, or, if the extraction of the support is not necessary, the hinge of the shock-absorbing spring fails to remain in place when the spring is disengaged from the support, creating a risk of losing the spring which measures less than 2 mm. It should also be added that the springs having a hinge on one end and fastening means on the other cannot be mounted on the support unless the hinge is placed in the part of the support shaped to receive it. The watchmaker must therefore identify the side of the spring acting as a hinge and the site of the bearing support shaped to receive this hinge, which, because of the dimensions, makes handling even more complicated, with the constant risk of losing the spring.

A shock-absorbing bearing of the aforementioned type to which the invention relates, particularly in respect of the shock-absorbing spring, was previously proposed in U.S. Pat. No. 3,306,028. The principal drawback of this bearing arises from the fact that the central support element of the shock-absorbing spring is connected to the bearing support by four arms, each of which has a length which is reduced by half compared with the total dimension of each of the two suspension elements linking the central support element to the bearing support.

In view of the very small dimensions of such a shock-absorbing spring, the halving of the length of the arms linking this central support element to the bearing support gives rise to a problem with respect to the consequent reduction of the elastic limit, so that this limit can easily be exceeded during the fastening of the arms for linking the shock-absorbing spring to the bearing support.

In case of shock, such a shock-absorbing spring can become disengaged more easily, especially if it has undergone plastic deformation during its fitting.

BRIEF SUMMARY OF THE INVENTION

The object of the present invention is to overcome, at least partially, the aforementioned drawbacks.

For this purpose, the invention proposes a shock-absorbing bearing for a timepiece as claimed in claim 1.

The principal advantage of the shock-absorbing bearing according to the present invention is due to the fact that the fastening of the two diametric arms of the central support element to two of the four arms for linking to the bearing support makes it possible to form, on either side of the diametric arms connecting the central support element to the two suspension elements, two resilient elements which facilitate the positioning of the spring because of the significant increase in the range of elastic deformation, while the diametric arms, attached on the one hand to the central support part and on the other hand to two linking arms, form a more rigid element passing through the pivot centre. This greater rigidity enables the shock resistance to be improved. The spring of the bearing proposed by the present invention is thus shaped to provide a division of functions between its different parts.

Preferably, the free ends of the linking arms terminate in fastening elements, the fastening elements of each pair of linking arms located opposite each other being turned towards the outer side of each pair of linking arms.

Advantageously, the two pairs of linking arms of the suspension spring, formed by the opposing linking arms of the two suspension elements, have a central symmetry with respect to the pivot axis of the bearing.

This characteristic has the advantage that it is possible to fix the spring to the bearing support in either of two possible positions, at 180° to each other about the pivot axis of the bearing, thus considerably facilitating the fitting operations. Furthermore, owing to this characteristic, either of the pairs of linking arms of the suspension spring, formed by the opposing linking arms of the two suspension elements, can be used equally well for opening the bearing or for acting as the spring hinge on the support. Thus, even if the different parts of the shock-absorbing spring have different functions, this spring has no direction of fitting to the bearing support, and this considerably simplifies the fitting operation.

Preferably, the shock-absorbing spring has a constant thickness and is flat in the rest state. Because of this characteristic, either of the faces of the spring can be placed above or below. In combination with the characteristic relating to the central symmetry, the spring can be placed in the bearing support without the previous choice of a face which is to be oriented above or below, or of a side which is to be used for opening or to act as a hinge.

The latter advantageous characteristic of flatness of the shock-absorbing spring facilitates the manufacture of the spring by a number of methods, the following examples of which can be mentioned without restrictive intent: the lithographic method known by the abbreviation LIGA (Lithographie Galvano-Abformung), electroforming, stamping, chemical milling and wire erosion.

In a preferred embodiment of the invention, the profile of the central support part of the shock-absorbing spring is chosen to act as a gauge for the quantity of oil in the bearing, and for this purpose it has at least two radial reference marks having different radii, one for determining the maximum quantity of oil and the other for determining the minimum quantity, and for determining the centering of this oil with respect to said pivot axis.

This profile makes it possible to ensure the presence of a drop of oil, to check the position of this drop and to measure its size with respect to the radial reference marks. This inspection operation can be carried out in a precise way, particularly with the aid of a camera.

In another advantageous variant of the invention, the fastening elements of the two linking arms which are not connected to the outer ends of the two diametric arms are longer than the fastening elements of the other two linking arms.

These fastening elements are therefore associated with the most elastic parts of the springs, thus reducing the risks of disengagement of the spring in case of shock.

Preferably the bearing support has a diametric passage extending on both sides of the seat of said endstone, to receive the linking arms of the shock-absorbing spring, and is shaped symmetrically with respect to any plane passing through said pivot axis.

The bearing with its diametric passage is designed to receive the spring with central symmetry in this diametric passage in either of the two possible positions. The fitting of the shock-absorbing spring does not have to be carried out in any particular sequence. This symmetry thus considerably simplifies the manufacture of the bearing support and does not require any block for hinging the spring, such a block always being, because of its size, a fragile element which is difficult to manufacture.

It is also possible to form chamfers along the edges of the diametric passage of the bearing support, so as to enable the shock-absorbing spring to be placed by simple translation parallel to the pivot axis. When a pressure parallel to the pivot axis is exerted on the linking arms of the shock-absorbing spring, the chamfers exert a force which brings the two opposing linking arms towards each other.

Shock tests conducted on shock-absorbing bearings as proposed by the present invention have shown that the shock-absorbing spring withstands even the most severe shocks without becoming disengaged from the bearing support. In extreme cases, abnormal shocks can cause a plastic deformation of the shock-absorbing spring. However, this has no troublesome effects on the movement of the watch, which can continue to operate normally since the shock-absorbing bearing retains its integrity, even if its shock-absorbing properties have been decreased.

The attached drawings show, schematically and by way of example, some variants of the shock-absorbing bearing proposed by the present invention.

DETAILED DESCRIPTION OF THE INVENTION

Figure 2:
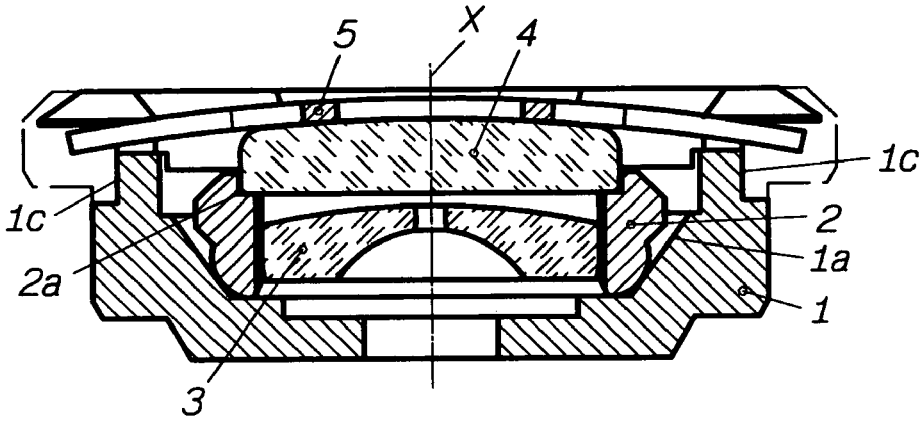
FIG. 2 is a sectional view taken along the line II-II of FIG. 1.
Figure 1:
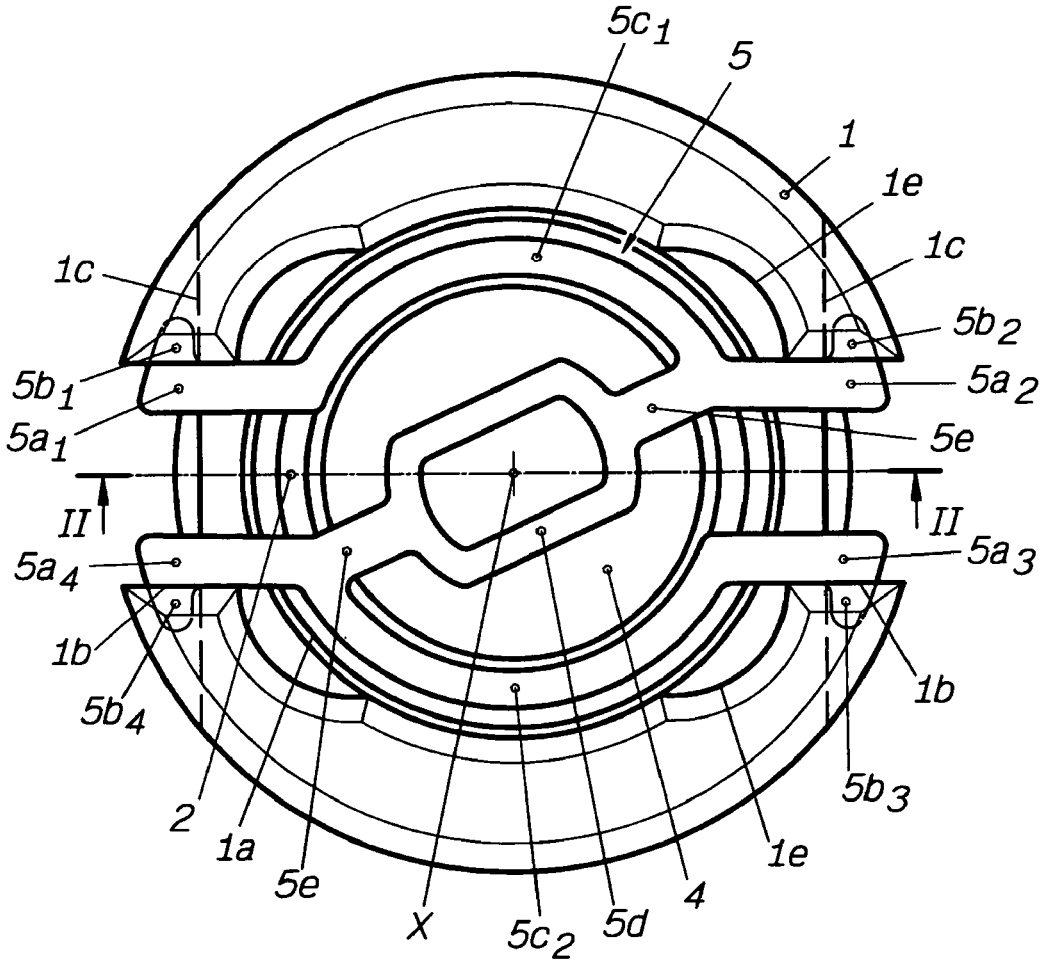
FIG. 1 is a view of this bearing from above.

The bearing shown in FIGS. 1 and 2 has a bearing block 1 comprising a seat in the form of a truncated conical cup 1*a* for positioning a chaton 2 which has a cylindrical part into which a pierced jewel 3 is pressed and which has a seat 2*a* for an endstone 4. A shock-absorbing spring 5 is fixed to the bearing block 1 to retain the chaton 2 and the endstone 4 in an elastic way in their respective seats 1*a*, 2*a*.

The bearing block 1 has the characteristic of being entirely symmetrical with respect to all the planes containing the pivot axis X of the bearing. A diametric milled area 1*b* is formed on the upper part of this bearing block and two parallel milled areas 1*c*, perpendicular to the diametric milled area 1*b*, are formed on the outside of the bearing block 1, in its thickness, at a certain distance from its upper face.

These three milled areas 1*b*, 1*c* are designed for the fixing of the four linking arms $\mathbf{5}a_1$, $\mathbf{5}a_2$, $\mathbf{5}a_3$, $\mathbf{5}a_4$ of the shock-absorbing spring 5, the two arms $\mathbf{5}a_1$, $\mathbf{5}a_4$ and $\mathbf{5}a_2$, $\mathbf{5}a_3$ respectively, located opposite each other, being parallel. The width of the diametric milled area 1*b* matches that of each pair of parallel arms $\mathbf{5}a_1$, $\mathbf{5}a_4$ and $5a_2$, $\mathbf{5}a_3$ respectively, located opposite each other. The two parallel milled areas 1*c* are designed to receive the respective fastening ends $\mathbf{5}b_1$, $\mathbf{5}b_2$, $\mathbf{5}b_3$, $\mathbf{5}b_4$, turned toward the outside of each pair of parallel arms, of the four linking arms $\mathbf{5}a_1$, $\mathbf{5}a_2$, $\mathbf{5}a_3$, $\mathbf{5}a_4$, thus enabling the shock-absorbing spring 5 to be fixed to the bearing block 1. Clearly, since the linking arms $\mathbf{5}a_1$, $\mathbf{5}a_2$, $\mathbf{5}a_3$, $\mathbf{5}a_4$ are parallel in pairs and since the gaps between the two pairs of arms $\mathbf{5}a_1$, $\mathbf{5}a_4$ and $5a_2$, $\mathbf{5}a_3$ respectively are equal, the shock-absorbing spring 5 can be positioned for fixing in the milled area 1*b* in either of two symmetrical positions at 180° to each other.

The two linking arms $\mathbf{5}a_1$, $\mathbf{5}a_2$ and $5a_3$, $\mathbf{5}a_4$ respectively, each located in the extension of the other, are connected to each other by two branches in the form of arcs $\mathbf{5}c_1$ and $5c_2$ respectively, which are centered on the pivot axis X and whose radii are greater than that of the endstone 4. These two branches in the form of arcs, in combination with the linking arms $\mathbf{5}a_1$, $\mathbf{5}a_2$ and $5a_3$, $\mathbf{5}a_4$ respectively, form two suspension elements, one on each side of a plane passing through the pivot axis X of the bearing and through the middle of the diametric milled area 1*b*.

The shock-absorbing spring 5 also has a central support element 5*d* connected to each of the two suspension elements $\mathbf{5}a_1$, $\mathbf{5}c_1$, $\mathbf{5}a_2$ and $5a_3$, $\mathbf{5}c_2$, $\mathbf{5}a_4$ respectively by two arms 5*e* aligned diametrically but connected, in this example, to the junctions between the arm $\mathbf{5}a_4$ and the branch in the form of an arc $\mathbf{5}c_2$, and between the arm $\mathbf{5}a_2$ and the branch in the form of an arc $\mathbf{5}c_1$, respectively. This specific arrangement provides two branches $\mathbf{5}a_1$, $\mathbf{5}c_1$ and $5a_3$, $\mathbf{5}c_2$ respectively, having considerably greater elasticity than that of the arms $\mathbf{5}a_2$, $\mathbf{5}a_4$, and designed to facilitate the placing of the spring and particularly to avoid the risks of plastic deformation of the arms during this manipulation. The arms $\mathbf{5}a_2$, $\mathbf{5}a_4$, connected to the diametric arms 5*e* and to the central support element 5*d*, form a significantly more rigid assembly designed to withstand shocks.

It can also be seen that the shock-absorbing spring 5 in its non-deformed state is flat, so that there is no top side or underside, and thus that either of its faces can be placed above or below for its fixing. This characteristic also facilitates its manufacture, which can be carried out, for example, by the LIGA method, by electroforming, by stamping, by chemical milling or by wire erosion.

The supporting element 5*d* of the spring can advantageously act as an oil gauge, for measuring the quantity of oil and the centering of the drop of oil between the pierced jewel 3 and the endstone 4. For this purpose, the shape imparted to the central supporting element is preferably chosen to enable the presence of oil, its centering and the quantity of oil to be determined by viewing through the transparent endstone 4. The first condition consists in the disengagement of the central part of the endstone 4. The shape of this supporting element 5*d*, similar to a rectangle, but with its two shorter sides in the form of arcs centered on the pivot axis X of the bearing, according to FIG. 2, makes it possible, for example, to choose the gap between the two long sides of this near-rectangle to match the minimum diameter of the oil drop, while its two opposing faces in the form of arcs can delimit the maximum diameter of the oil drop.

Figure 3:
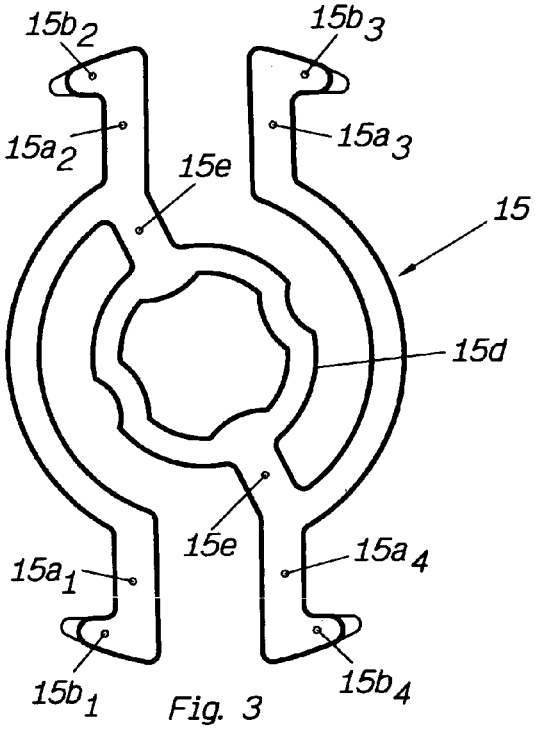
FIGS. 3 to 6 are plan views of three variants of shock-absorbing springs.

In the variant of FIG. 3, a shock-absorbing spring 15 has a central supporting element 15*d* whose central opening is formed by the alternation of eight convex and concave arcs, the four convex arcs being coaxial with the pivot axis X of the bearing and having the same radii, while the four concave arcs have the same radii, their centers being located on the same circle concentric with the pivot axis X of the bearing and spaced at 90° from each other around the pivot axis X of the bearing. The two diametric arms 15*e* are connected to the central support element 15*d* by two opposing concave arcs. The other two parts with a concave profile of the central support element 15*d* are delimited externally by two arcs which are concentric with these other two parts with a concave profile but which have smaller radii, and which can also be used to measure the quantity of oil.

As shown in broken lines in FIG. 3, the fastening ends 15$b_1$, 15$b_2$, 15$b_3$, 15$b_4$ of the linking arms 15$a_1$, 15$a_2$, 15$a_3$, 15$a_4$ can be elongated with respect to those of FIG. 2. It would also be possible to elongate only the ends 15$b_1$, 15$b_3$ of the more elastic linking arms, since they are more likely than the other two to become disengaged in case of shock.

Figure 4:
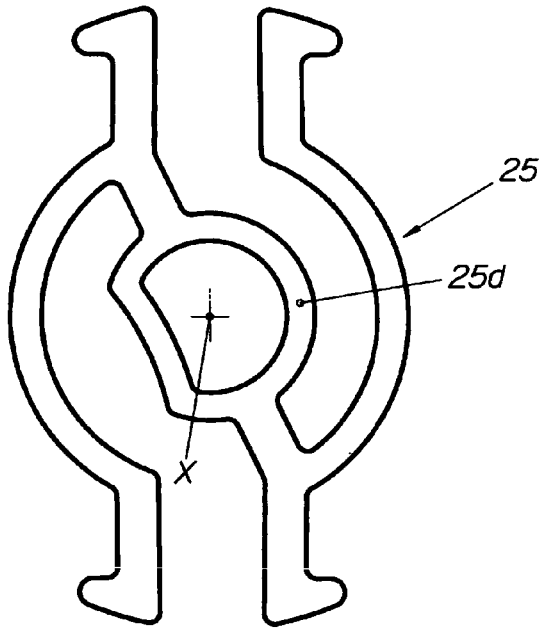

FIG. 4 shows yet another variant of the shape of the supporting element 25*d* of the spring 25, which has, on one side of the diametric arms 25*e*, a part in the form of an arc concentric with the pivot axis X of the bearing, and, on the other side of these diametric arms 25*e*, two portions of the arc extending beyond these diametric arms 25*e* by the same angular quantity and having their ends connected to each other by a segment in the form of a concave arc whose radius is significantly greater than that of the part in the form of an arc centered on the pivot axis X, or by a straight segment.

Figure 5:
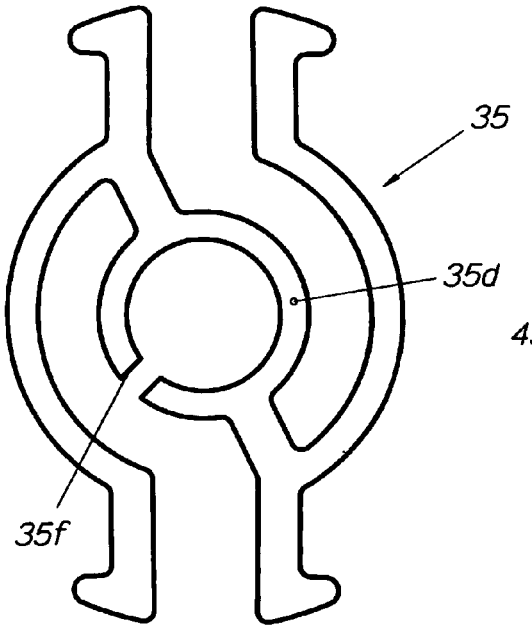

In the variant shown in FIG. 5, the central supporting element 35*d* is annular. Given that this shape has the drawback that the presence or absence of oil cannot be detected if the edge of the meniscus formed by the oil drop is located in the width of the ring, the ring has a radial cut-out 35*f* which enables the meniscus to be seen.

Referring to FIGS. 1 and 2 again, it will be seen that chamfers are formed, particularly on the two sides of the diametric milled area 1*b* of the bearing block 1. These chamfers can be used to convert a pressure exerted on the linking arms 5$a_1$, 5$a_2$, 5$a_3$, 5$a_4$ of the shock-absorbing spring into forces which tend to bring together the two opposing parallel arms 5$a_1$, 5$a_4$ and 5$a_2$, 5$a_3$ respectively, in such a way that it is possible to place the shock-absorbing spring by simple translation with a simultaneous exertion of pressure on the four linking arms 5$a_1$, 5$a_2$, 5$a_3$, 5$a_4$.

Recesses 1*e* are formed in the upper face of the bearing block 1 in the locations where the parallel edges of the diametric milled area 1*b* open into the truncated conical seat 1*a* of the chaton 2. These recesses 1*e* make it possible to introduce the points of tweezers or pins to disengage the fastening ends 5$b_1$, 5$b_2$, 5$b_3$, 5$b_4$ of the linking arms 5$a_1$, 5$a_2$, 5$a_3$, 5$a_4$ from the bearing block 1. It should be noted that it is possible to disengage only one pair of opposing parallel linking arms 5$a_1$, 5$a_4$ or 5$a_2$, 5$a_3$, the other pair being used as a hinge to release the endstone 4.

Figure 6:
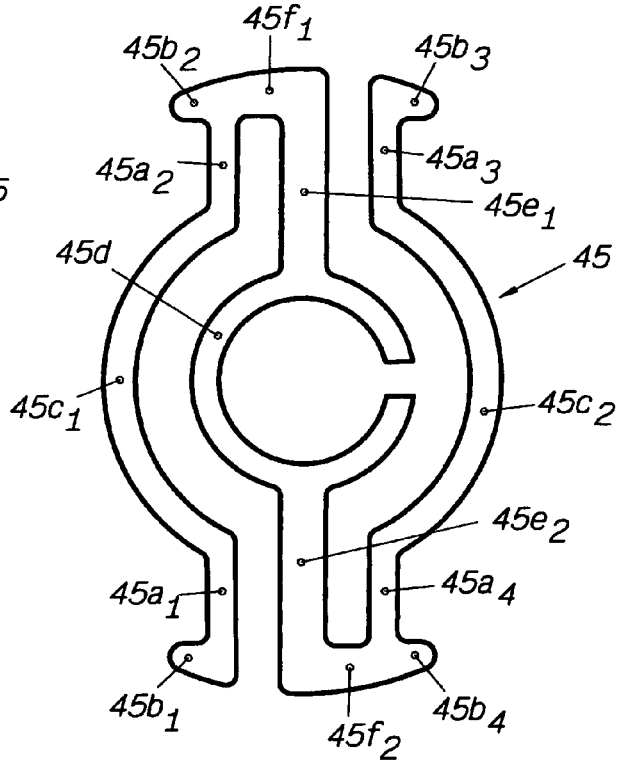

The variant of the shock-absorbing spring 45 shown in FIG. 6 differs from the other springs described above essentially in that the diametric arms 45*e* are not connected to the junctions between two linking arms 5$a_2$, 5$a_4$ and the branches in the form of arcs 5$c_1$ and 5$c_2$ respectively, as in the case of FIG. 2 for example, but these diametric arms 45*e* are connected to the outer ends of the linking arms 45$a_2$ and 45$a_4$ respectively by a connecting segment 45$f_1$ and 45$f_2$ respectively. By being connected to the outer ends of the linking arms 45$a_2$ and 45$a_4$ respectively, the diametric arms 45*e* are effectively connected to the respective fastening ends 45$b_2$, 45$b_4$ of these linking arms 45$a_2$, 45$a_4$. In this variant, the elastic branches are elongated further, since each one has the set of the two suspension elements 45$a_1$, 45$c_1$, 45$a_2$ or 45$a_3$, 45$c_2$, 45$a_4$ respectively.

The invention claimed is:

1. A shock-absorbing bearing for a timepiece, comprising a bearing block, a pierced bearing jewel, a seat for positioning this bearing jewel in this bearing block, an endstone, a seat for positioning this endstone in this bearing block, and a shock-absorbing spring for retaining said endstone against said positioning seat, this shock-absorbing spring being connected to said bearing block by four linking arms parallel to a plane containing the pivot axis of said bearing and forming, on each side of this plane, a suspension element having two of said linking arms connected to each other by a branch in the form of an arc centered on said pivot axis and having a radius greater than that of said endstone, these suspension elements being connected to each other by two diametric arms located on either side of a central support element, wherein the outer ends of said diametric arms are connected to two of said linking arms belonging to the respective said suspension elements.

2. The bearing as claimed in claim 1, in which the outer ends of said diametric arms are connected to the respective said suspension elements, at the junctions between said linking arms and the respective branches in the form of arcs.

3. The bearing as claimed in claim 1, in which the outer ends of said diametric arms are connected respectively to an end for linking to said bearing support of a linking arm of each of said suspension elements.

4. The bearing as claimed in claim 1, in which the free ends of said linking arms terminate in fastening elements, the fastening elements of each pair of opposing linking arms being turned towards the outer side of these respective pairs of linking arms.

5. The bearing as claimed in claim 1, in which the two pairs of linking arms of the shock-absorbing spring, formed by the opposing linking arms of the two suspension elements, have a central symmetry with respect to said pivot axis.

6. The bearing as claimed in claim 1, in which said shock-absorbing spring has a constant thickness and is flat in the resting state.

7. The bearing as claimed in claim 1, in which the profile of said central support part of the shock-absorbing spring is cut out in its center and is chosen to act as a gauge for the quantity of oil in the bearing, and for this purpose has at least two radial reference marks having different radii, one for determining the maximum quantity of oil and the other for determining the minimum quantity, and for determining the centering of this oil with respect to said pivot axis.

8. The bearing as claimed in claim 5, in which said bearing support has a diametric passage on either side of the seat of said bearing jewel, to receive the linking arms of the shock-absorbing spring and is shaped with central symmetry with respect to said pivot axis of the bearing.

9. The bearing as claimed in claim 4, in which the fastening elements of the two linking arms which are not connected to the outer ends of the two diametric arms are longer than the fastening elements of the other two linking arms.

10. The bearing as claimed in claim 8, in which recesses are formed in said bearing support on the outer edges of said diametric passage located on either side of the seat of said bearing jewel, to facilitate the disengagement of the linking arms of the shock-absorbing spring.

11. The bearing as claimed in claim 4, in which chamfers are formed along the edges of said diametric passage to increase its width to a value substantially equal to the width of the fastening elements of each opposing pair of linking arms of the shock-absorbing spring, to enable this shock-absorbing spring to be placed by simple translation parallel to said pivot axis of the bearing.

12. The bearing as claimed in claim 8, in which chamfers are formed along the edges of said diametric passage to increase its width to a value substantially equal to the width of the fastening elements of each opposing pair of linking arms of the shock-absorbing spring, to enable this shock-absorbing spring to be placed by simple translation parallel to said pivot axis of the bearing.

* * * * *